US011743658B2

(12) United States Patent
Froemel et al.

(10) Patent No.: US 11,743,658 B2
(45) Date of Patent: Aug. 29, 2023

(54) ELECTROSTATIC ACOUSTIC WAVE GENERATING DEVICE AND ELECTROSTATIC SPEAKER

(71) Applicant: TOHOKU UNIVERSITY, Sendai (JP)

(72) Inventors: Joerg Froemel, Sendai (JP); Shuji Tanaka, Sendai (JP); Koichi Ohtaka, Sendai (JP)

(73) Assignee: TOHOKU UNIVERSITY, Sendai (JP)

( * ) Notice: Subject to any disclaimer, the term of this patent is extended or adjusted under 35 U.S.C. 154(b) by 126 days.

(21) Appl. No.: 17/410,875

(22) Filed: Aug. 24, 2021

(65) Prior Publication Data

US 2021/0385585 A1 Dec. 9, 2021

Related U.S. Application Data

(63) Continuation of application No. PCT/JP2019/007012, filed on Feb. 25, 2019.

(51) Int. Cl.

| | |
|---|---|
| ***H04R 19/02*** | (2006.01) |
| ***H04R 7/04*** | (2006.01) |
| ***H04R 19/00*** | (2006.01) |

(52) U.S. Cl.

CPC ..... *H04R 19/005* (2013.01); *H04R 19/02* (2013.01)

(58) Field of Classification Search

CPC ..... H04R 19/005; H04R 19/02; H04R 7/04

See application file for complete search history.

(56) References Cited

U.S. PATENT DOCUMENTS 6,842,964 B1 1/2005 Tucker et al.
9,181,080 B2 11/2015 Dehe et al.

(Continued)

FOREIGN PATENT DOCUMENTS

EP 2410768 A1 1/2012
EP 2464142 A2 6/2012

(Continued)

OTHER PUBLICATIONS

Shahosseini, Iman., "Electromagnetic MEMS microspeaker for portable electronic devices", Feb. 26, 2013, Microsyst Technol, vol. 19, pp. 879-886.

(Continued)

*Primary Examiner* — Suhan Ni
(74) *Attorney, Agent, or Firm* — Oliff PLC

(57) ABSTRACT

An electrostatic acoustic wave generating device and an electrostatic speaker making entries of dust, water, moisture, etc. into the device and the speaker, allowing reduction in power. A plate-like fixed electrode has a through hole penetrating the thickness of the fixed electrode. A vibrating body and a vibrating electrode each having a plate-like shape are arranged closer to one surface and closer to the other surface of the fixed electrode respectively, and are movable in the respective thickness directions thereof. A connection member connects the vibrating body and the vibrating electrode to each other through the through hole of the fixed electrode to cause the vibrating body and the vibrating electrode to move toward the same direction. Voice signal input is capable of applying a voltage to the fixed electrode, the vibrating body, and the vibrating electrode to move the vibrating body between the fixed electrode and the vibrating body.

6 Claims, 8 Drawing Sheets

(56) References Cited

U.S. PATENT DOCUMENTS

| | | | | |
|---|---|---|---|---|
| 9,986,344 | B2 | 5/2018 | Dehe et al. | |
| 2011/0033079 | A1 | 2/2011 | Liou et al. | |
| 2016/0066099 | A1 | 3/2016 | Dehe et al. | |
| 2017/0238107 | A1* | 8/2017 | Walther | B81C 1/00158 438/53 |
| 2018/0255402 | A1 | 9/2018 | Dehe | |
| 2019/0352176 | A1* | 11/2019 | Doller | B81B 7/0048 |

FOREIGN PATENT DOCUMENTS

| | | | |
|---|---|---|---|
| EP | 2582156 | A2 | 4/2013 |
| JP | S51-155637 | U | 12/1976 |
| JP | 3281887 | B2 | 5/2002 |
| JP | 2012-80531 | A | 4/2012 |
| JP | 2019-080091 | A | 5/2019 |
| JP | 6758654 | B2 | 9/2020 |

OTHER PUBLICATIONS

May 14, 2019 International Search Report issued in International Patent Application No. PCT/JP2019/007012.

* cited by examiner

ELECTROSTATIC ACOUSTIC WAVE GENERATING DEVICE AND ELECTROSTATIC SPEAKER

FIELD OF THE INVENTION

The present invention relates to an electrostatic acoustic wave generating device and an electrostatic speaker.

DESCRIPTION OF RELATED ART

As a speaker belonging to an acoustic wave generating device and used for outputting an acoustic wave in an audible range, a dynamic speaker using electromagnetic force (electrodynamic speaker) is used in many cases (see Non-Patent Literature 1, for example). In the dynamic speaker, a coil is attached to a diaphragm to increase the weight of the diaphragm. Hence, in outputting an acoustic wave, strong force is required to be applied for causing the diaphragm to vibrate. At this time, the inertial force of the diaphragm during the vibration is increased, causing a problem of deviation between an input electrical signal and the vibration of the diaphragm. Regarding a small speaker such as an earphone, in particular, the inertial force of the diaphragm is increased relatively, causing a problem of increased deviation between the electrical signal and the vibration.

An electrostatic speaker has been used to solve the foregoing problem (see Patent Literatures 1 to 5, for example). As shown in FIG. 8, the electrostatic speaker includes two fixed electrodes 52 arranged in such a manner that a diaphragm 51 is held therebetween. As shown in FIGS. 9 (*a*) and (*b*), for example, in this electrostatic speaker, the diaphragm 51 is charged positively or negatively and an electrical signal of opposite polarity to the diaphragm 51 is applied to each fixed electrode 52, thereby causing the diaphragm 51 to vibrate using electrostatic attraction acting between the diaphragm 51 and each fixed electrode 52 to output an acoustic wave. The electrostatic speaker does not include an attachment such as a coil to the diaphragm 51 and is configured to cause the diaphragm 51 to vibrate in response to an electrical signal. The electrostatic speaker has a simple configuration and has an advantage over the dynamic speaker in terms of low power consumption.

CITATION LIST

Non-Patent Literature

Non-Patent Literature 1: Iman Shahosseini, et al., "Electromagnetic MEMS microspeaker for portable electronic devices", Microsystem Technologies, June 2013, Volume 19, Issue 6, pp. 879-886

Patent Literatures

Patent Literature 1: US-B-U.S. Pat. No. 6,842,964
Patent Literature 2: EP-A-2410768
Patent Literature 3: EP-A-2464142
Patent Literature 4: EP-A-2582156
Patent Literature 5: JP-B-3281887

SUMMARY OF THE INVENTION

As shown in FIGS. 8 and 9, in the conventional electrostatic speakers such as those disclosed in Patent Literatures 1 to 5, one or a plurality of holes 52*a* is required to be formed at each fixed electrode 52 in order to transmit an acoustic wave generated by the vibration of the diaphragm 51 to the outside. This causes a problem that dust, water, moisture, etc. are likely to come in between the diaphragm 51 and each fixed electrode 52 through the hole 52*a* to adhere to the diaphragm 51 or each fixed electrode 52 due to static electricity. The adhesion of dust, water content, etc. to the diaphragm 51 or each fixed electrode 52 leads to a short-circuit between the diaphragm 51 and each fixed electrode 52 to result in discharge, causing damage of the diaphragm 51 or breakage of the diaphragm 51 due to formation of a hole.

The presence of the hole 52*a* reduces the surface area of each fixed electrode 52 to reduce electrostatic force to act. As compensation for this, a voltage to be applied to the diaphragm 51 and each fixed electrode 52 is required to be increased to cause a problem of increased power consumption. Furthermore, during passage of an acoustic wave from the diaphragm 51 through the hole 52*a* at each fixed electrode 52, the frequency of the acoustic wave may be affected by the size or shape of the hole 52*a* at each fixed electrode 52, for example, causing disturbance in the waveform of the acoustic wave. This further causes a problem of reduced sound quality.

The present invention has been made by putting focus on the foregoing problems, and is intended to provide an electrostatic acoustic wave generating device and an electrostatic speaker making entries of dust, water, moisture, etc. into the device and the speaker unlikely, allowing reduction in power consumption, and allowing increased sound quality.

To fulfill the foregoing intention, an electrostatic acoustic wave generating device according to the present invention includes: a fixed electrode of a plate-like shape having one through hole penetrating the thickness of the fixed electrode; a vibrating body of a plate-like or film-like shape arranged closer to one surface of the fixed electrode in such a manner as to face the fixed electrode, and movable at least at the center in the thickness direction thereof relative to the fixed electrode; a vibrating electrode of a plate-like or film-like shape arranged closer to the other surface of the fixed electrode in such a manner as to face the fixed electrode, and movable at least at the center in the thickness direction thereof relative to the fixed electrode; a connection member connecting the vibrating body and the vibrating electrode to each other through the through hole of the fixed electrode in such a manner as to cause the vibrating body and the vibrating electrode to move toward the same direction.

In the electrostatic acoustic wave generating device according to the present invention, the through hole may be provided in the center of the fixed electrode through the thickness; and the connection member may be connecting the center of the vibrating body and the center of the vibrating electrode to each other through the through hole of the fixed electrode.

The electrostatic acoustic wave generating device according to the present invention may be configured to move the vibrating body using electrostatic attraction between the fixed electrode and the vibrating body and move the vibrating electrode using electrostatic attraction between the fixed electrode and the vibrating electrode.

The electrostatic acoustic wave generating device according to the present invention may include voice signal input means configured to be capable of applying a voltage to the fixed electrode, the vibrating body, and the vibrating electrode.

The electrostatic acoustic wave generating device according to the present invention can output an acoustic wave on the basis of the following principles. Specifically, like in an example shown in FIG. 1, in the electrostatic acoustic wave generating device according to the present invention, a vibrating body 12 and a vibrating electrode 13 are arranged in such a manner that a fixed electrode 11 is held therebetween, and a connection member 14 connects the vibrating body 12 and the vibrating electrode 13 to each other through a through hole 11*a* of the fixed electrode 11. As shown in FIG. 2 (*a*), for example, the electrostatic acoustic wave generating device according to the present invention can move the vibrating body 12 toward the fixed electrode 11 using electrostatic attraction caused to act between the vibrating body 12 and the fixed electrode 11 by causing the voice signal input means to apply a voltage to the fixed electrode 11 to charge the fixed electrode 11 negatively, and in this state, to apply a voltage to the vibrating body 12 and feed an electrical signal having opposite polarity to the fixed electrode 11 to the vibrating body 12, thereby charging the vibrating body 12 positively. Likewise, as shown in FIG. 2 (*b*), the vibrating electrode 13 can be moved toward the fixed electrode 11 using electrostatic attraction caused to act between the vibrating electrode 13 and the fixed electrode 11 by applying a voltage to the vibrating electrode 13, and feeding an electrical signal having opposite polarity to the fixed electrode 11 to the vibrating electrode 13, thereby charging the vibrating electrode 13 positively. In this case, as the vibrating body 12 and the vibrating electrode 13 move toward the same direction across the connection member 14, the vibrating body 12 becomes capable of moving toward the opposite side of the fixed electrode 11. In this way, causing the voice signal input means to apply a voltage to the vibrating body 12 and the vibrating electrode 13 in response to a voice signal allows the vibrating body 12 to vibrate, thereby outputting an acoustic wave.

The electrostatic acoustic wave generating device according to the present invention is applicable not only to the configuration shown in FIG. 2 but is further applicable to a case of charging the fixed electrode 11 positively and charging the vibrating body 12 and the vibrating electrode 13 negatively, for example. Even in this case, the vibrating body 12 can still be allowed to vibrate in the same way to output an acoustic wave.

In the electrostatic acoustic wave generating device according to the present invention, as long as a voltage to be applied by the voice signal input means to the fixed electrode, the vibrating body, and the vibrating electrode is to allow the vibrating body to vibrate in response to a voice signal, any voltage is applicable. For example, the voice signal input means may be configured to apply a positive or negative bias voltage to the fixed electrode, convert a voice signal to an analog signal on the basis of the bias voltage, generate an inversion signal by inverting the polarity of the analog signal, and apply the analog signal and the inversion signal to the vibrating body and the vibrating electrode respectively or to the vibrating electrode and the vibrating body respectively. The voltage to be applied in this case can be the same as a voltage to be applied to each of the diaphragm 51, one of the fixed electrodes 52, and the other fixed electrode 52 in the conventional electrostatic speaker such as that shown in FIGS. 8 and 9.

In the electrostatic acoustic wave generating device according to the present invention, the vibrating body and the vibrating electrode are arranged in such a manner that the fixed electrode is held therebetween, and a hole is not required to be formed at the external vibrating body and vibrating electrode. This makes it unlikely that dust, water, moisture, etc. will come in between the fixed electrode and the vibrating body or between the fixed electrode and the vibrating electrode, in comparison to the conventional electrostatic speaker in which a hole is formed at each external fixed electrode. Thus, it becomes possible to suppress adhesion of dust, etc. to the vibrating body, the vibrating electrode, and the fixed electrode and to prevent the occurrence of discharge, thereby allowing extension of the lifetime of the vibrating body.

In the electrostatic acoustic wave generating device according to the present invention, the through hole formed at the fixed electrode is used only for the passage of the connection member. This makes it possible to reduce the ratio of the hole relative to the surface area of the fixed electrode considerably in comparison to a hole used for passage of an acoustic wave. For this reason, even in the presence of the through hole, the through hole causes little reduction in electrostatic attraction. Thus, it is still possible to reduce power consumption in comparison to the conventional electrostatic speaker largely affected by the hole at each fixed electrode. A clearance between the through hole with the passed connection member and the passed connection member is available for air passage between space around the fixed electrode closer to the vibrating body and space around the fixed electrode closer to the vibrating electrode during vibration of the vibrating body or the vibrating electrode.

In the electrostatic acoustic wave generating device according to the present invention, as the vibrating body is arranged external to the fixed electrode, an acoustic wave output from the vibrating body can be transmitted to the outside without disturbance in the waveform of the acoustic wave caused by interference, thereby allowing increased sound quality.

The electrostatic acoustic wave generating device according to the present invention may include a support fixing the fixed electrode at a peripheral portion of the fixed electrode and supporting at least one of the vibrating body and the vibrating electrode at a peripheral portion of the corresponding vibrating body or vibrating electrode. In this case, both the vibrating body and the vibrating electrode may be supported by the support. As the vibrating body and the vibrating electrode are connected each other through the connection member, however, only one of the vibrating body and the vibrating electrode may be supported by the support.

In the electrostatic acoustic wave generating device according to the present invention, as long as each of the vibrating body and the vibrating electrode is provided to be movable at least at the center in the thickness direction thereof, any configuration is applicable to each of the vibrating body and the vibrating electrode. The vibrating body and the vibrating electrode may be made of the same material or may have the same configuration, or may be made of different materials or may have different configurations. For example, each of the vibrating body and the vibrating electrode may be composed of a thin film made of a flexible material such as parylene, polyethylene (PE), or metallic glass, and may be fixed at its peripheral portion to a frame-like support, for example. This film has a thickness that is preferably equal to or less than 50 μm, particularly preferably, equal to or less than 20 μm. This film has a Young's modulus that is preferably equal to or less than 80 GPa, particularly preferably, equal to or less than 50 GPa.

Each of the vibrating body and the vibrating electrode may have a center composed of a rigid plate made of silicon, ceramic, or metal such as Al, Cu, or Ni, and a peripheral portion made of a flexible and thin material. The peripheral portion may be fixed by the frame-like support. Preferably, the center has a size of equal to or less than 100 μm in diameter. Each of the vibrating body and the vibrating electrode may entirely be composed of a rigid plate made of silicon, ceramic, or metal such as Al, Cu, or Ni, and may have a peripheral portion fixed by a frame-like support through a member such as a plate spring. The member such as a plate spring may be made of the same material as or a different material from the vibrating body or the vibrating electrode.

While each of the vibrating body and the vibrating electrode is preferably made of a low-resistance material such as a conductor for allowing conduction of electricity in response to application of a voltage by the voice signal input means, it may be composed of an insulator with a conductor layer covering at least a surface thereof closer to the fixed electrode. The conductor layer is made of carbon, metal, or silicon doped with impurity, for example.

Preferably, the fixed electrode is composed of a rigid plate made of silicon, ceramic, or metal such as Al, Cu, or Ni. Preferably, at least a part of the connection member is electrically insulated. The insulating part is preferably made of polymer such as epoxy resin or benzocyclobutene or ceramic, for example, and preferably has a resistance value of equal to or greater than 1 MΩ.

The electrostatic acoustic wave generating device according to the present invention is available for any purpose, as long as the purpose is for generating an acoustic wave. An "acoustic wave" mentioned in the present description includes not only an elastic wave of a frequency in an audible range but also an elastic wave of a frequency in a range other than an audible range. The electrostatic acoustic wave generating device according to the present invention may be configured as an electrostatic speaker configured to be capable of generating an acoustic wave in an audible range in response to vibration of the vibrating body caused by the voice signal input means, as an ultrasonic wave generating device configured to be capable of generating an ultrasonic wave of a frequency in a range hither than an audible range, or as an infrasonic wave generating device configured to be capable of generating an infrasonic wave of a frequency in a range lower than an audible range, for example. While an audible range differs from person to person, it is generally from 20 Hz to 20 kHz.

An electrostatic acoustic wave generating device and an electrostatic speaker provided by the present invention make entries of dust, water, moisture, etc. into the device and the speaker unlikely, allow reduction in power consumption, and allow increased sound quality.

DETAILED DESCRIPTION OF THE INVENTION

An embodiment of the present invention will be described below on the basis of the drawings.

FIGS. 3 to 7 show an electrostatic acoustic wave generating device according to the embodiment of the present invention.

Figure 3:
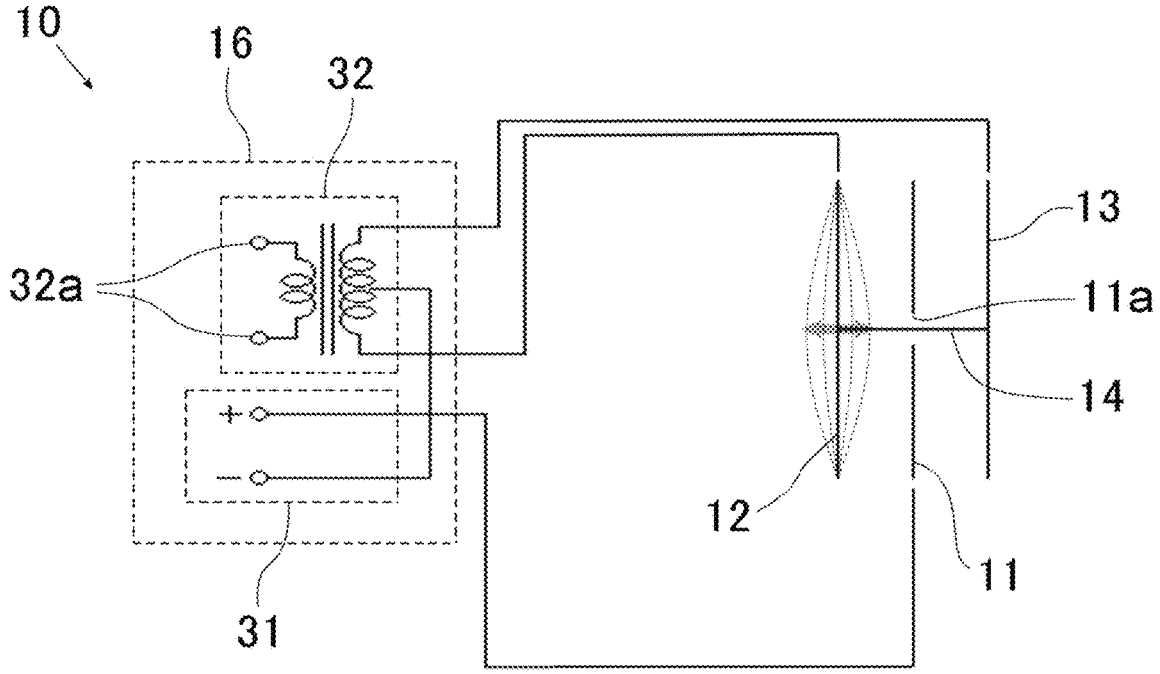
FIG. 3 is a circuit diagram showing an electrostatic acoustic wave generating device according to an embodiment of the present invention.
Figure 4:
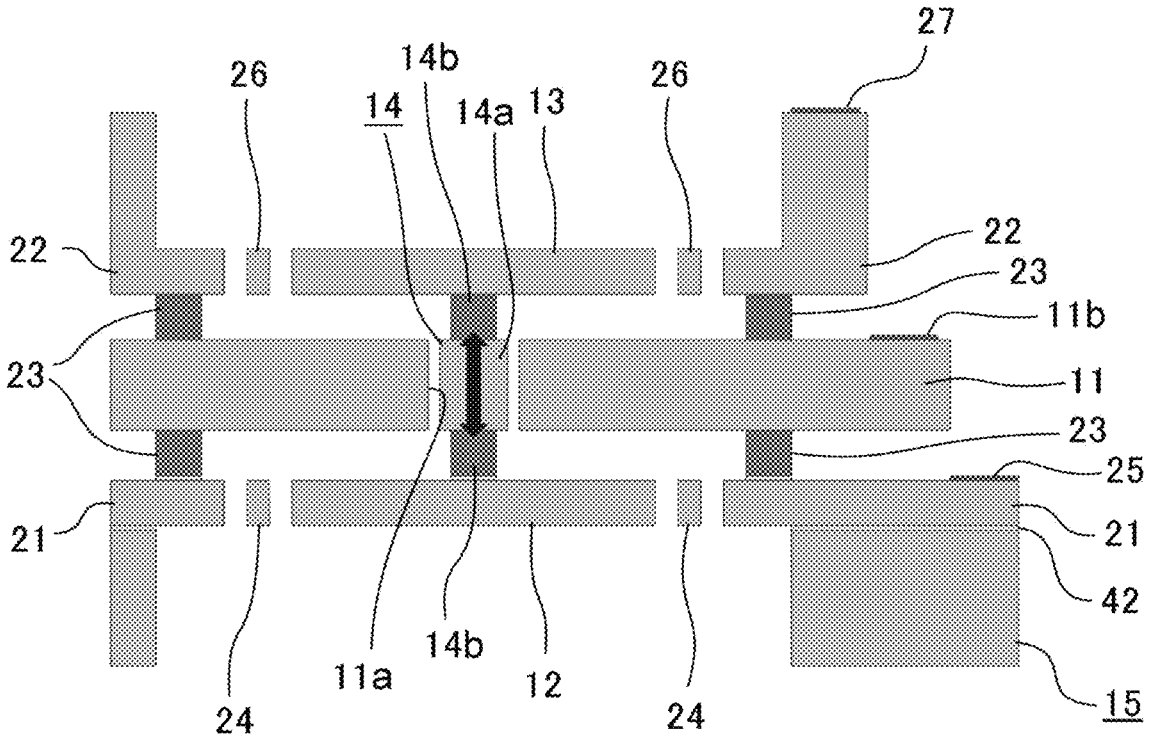
FIG. 4 is a sectional view showing a voice generator of the electrostatic acoustic wave generating device according to the embodiment of the present invention.

As shown in FIGS. 3 and 4, an electrostatic acoustic wave generating device 10 includes a fixed electrode 11, a vibrating body 12, a vibrating electrode 13, a connection member 14, a support 15, and voice signal input means 16.

As shown in FIGS. 3 and 4, the fixed electrode 11 has a circular plate-like shape and is provided with a through hole 11*a* at the center penetrating the thickness of the fixed electrode 11. The fixed electrode 11 includes a terminal 11*b* formed at is end. The vibrating body 12 has a smaller diameter than the fixed electrode 11 and has a thin circular plate-like shape. The vibrating body 12 is arranged closer to one surface of the fixed electrode 11 in such a manner as to face the fixed electrode 11. The vibrating electrode 13 has a circular plate-like shape of the same diameter and the same thickness as the vibrating body 12. The vibrating electrode 13 is arranged closer to the other surface of the fixed electrode 11 in such a manner as to face the fixed electrode 11. The connection member 14 has an elongated rod-like shape and connects the vibrating body 12 and the vibrating electrode 13 to each other through the through hole 11*a* at the fixed electrode 11. The connection member 14 have both ends each fixed to a corresponding one of the center of the vibrating body 12 and to the center of the vibrating electrode 13.

As shown in FIG. 4, the support 15 has a first frame 21 provided in such a manner as to surround the vibrating body 12, a second frame 22 provided in such a manner as to surround the vibrating electrode 13, and a fixing member 23 for fixing the fixed electrode 11. The first frame 21 and the second frame 22 are arranged in such a manner that the fixed electrode 11 is held therebetween. The first frame 21 is provided with a plurality of plate springs 24 arranged along an internal periphery thereof. By fixing an internal end of each plate spring 24 to a peripheral portion of the vibrating body 12, the vibrating body 12 becomes supported by the first frame 21. The first frame 21 includes a terminal 25 formed at its end. The second frame 22 is provided with a plurality of plate springs 26 arranged along an internal periphery thereof. By fixing an internal end of each plate spring 26 to a peripheral portion of the vibrating electrode 13, the vibrating electrode 13 becomes supported by the second frame 22. The second frame 22 includes a terminal 27 formed at its end. For fixing the fixed electrode 11 between the first frame 21 and the second frame 22, the fixing member 23 includes a plurality of the fixing members 23 provided between the first frame 21 and the one surface of the fixed electrode 11 and between the second frame 22 and the other surface of the fixed electrode 11. The fixing member 23 is fixed to a peripheral portion of the fixed electrode 11.

As a result, the vibrating body 12 becomes configured to be capable of vibrating in the thickness direction thereof relative to the fixed electrode 11 through each plate spring 24. The vibrating electrode 13 becomes configured to be capable of vibrating in the thickness direction thereof relative to the fixed electrode 11 through each plate spring 26. The vibrating body 12 and the vibrating electrode 13 are caused to move toward the same direction and to vibrate simultaneously by the connection member 14.

In the example shown in FIG. 4, the fixed electrode 11, the vibrating body 12, and the vibrating electrode 13 are made of low-resistance conductive silicon. The connection member 14 has a center 14*a* made of conductive silicon, and both ends 14*b* made of insulating epoxy resin SU-8 each connected to a corresponding one of the vibrating body 12 and the vibrating electrode 13. The first frame 21 includes an oxide silicon insulating layer 42 interposed in low-resistance conductive silicon. The second frame 22 is made of low-resistance conductive silicon. The fixing member 23 is made of insulating epoxy resin SU-8. The terminal 11*b* of the fixed electrode 11, the terminal 25 of the first frame 21, and the terminal 27 of the second frame 22 are made of conductive Ti/Au layers.

Figure 2:
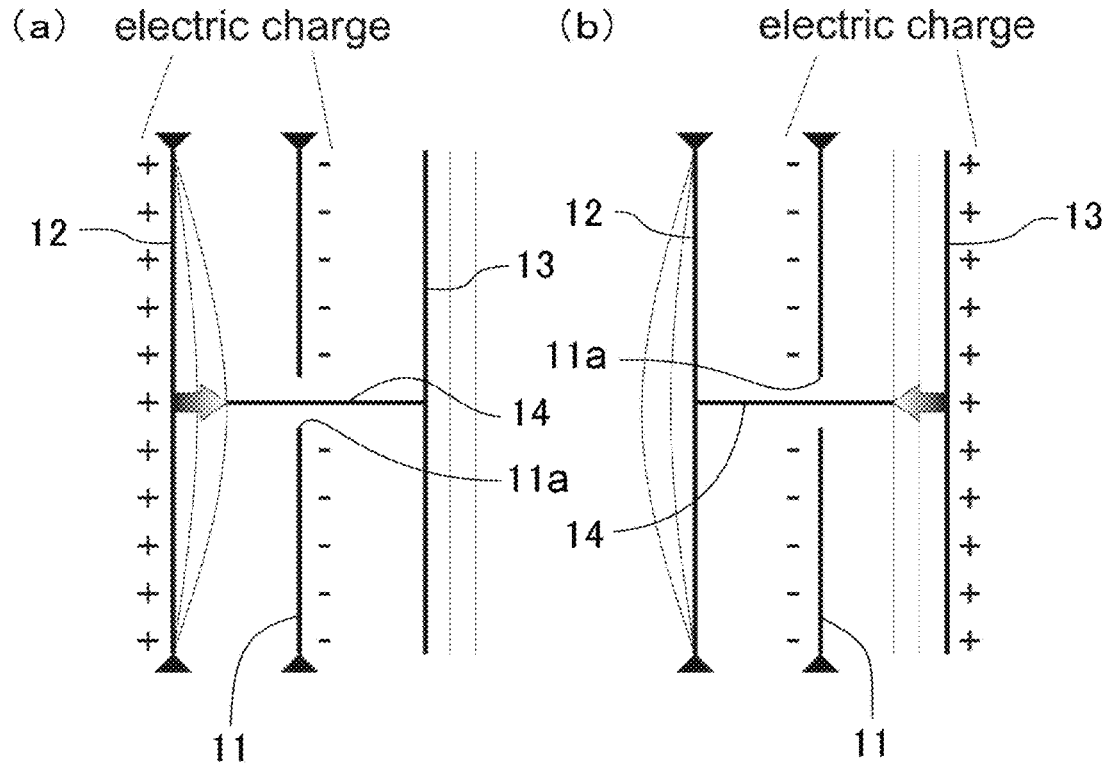
FIG. 2 is an explanatory view showing principles of outputting an acoustic wave in the electrostatic acoustic wave generating device according to the present invention applied when (a) electrostatic attraction is caused to act between a vibrating body and a fixed electrode, and (b) electrostatic attraction is caused to act between a vibrating electrode and the fixed electrode.

As shown in FIG. 3, the voice signal input means 16 includes a bias generator 31 and a voltage converter 32. The bias generator 31 generates positive and negative bias voltages, and supplies the positive bias voltage to the fixed electrode 11 through the terminal 11*b* of the fixed electrode 11. The bias generator 31 supplies the negative bias voltage to the voltage converter 32. The voltage converter 32 inputs a voice signal from a voice input terminal 32*a*, and converts the input voice signal to an analog signal of a positive voltage of a higher bias potential than the negative bias voltage supplied from the bias generator 31 or of a negative voltage of a lower bias potential than this negative bias voltage. The voltage converter 32 supplies the analog signal resulting from the conversion to the vibrating body 12 through the terminal 25 of the first frame 21, and supplies an inversion signal resulting from inversion of the polarity of the analog signal to the vibrating electrode 13 through the terminal 27 of the second frame 22. In this way, on the basis of the principles shown in FIG. 2, the electrostatic acoustic wave generating device 10 causes the vibrating body 12 to vibrate using electrostatic attraction acting between the vibrating body 12 and the fixed electrode 11 and electrostatic attraction acting between the vibrating electrode 13 and the fixed electrode 11, thereby generating an acoustic wave.

Figure 5:
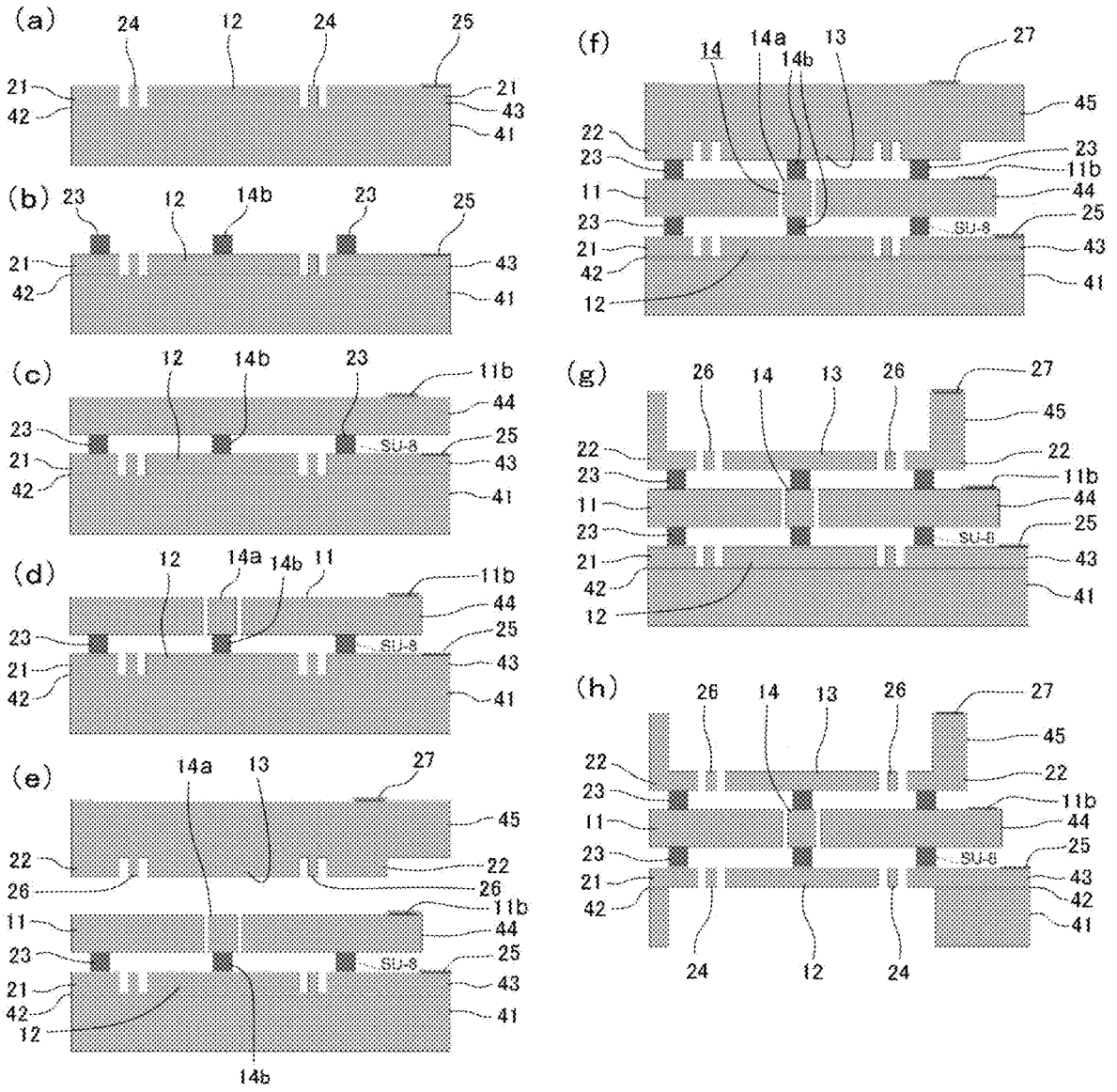
FIG. 5 is a sectional view showing a method of manufacturing the voice generator of the electrostatic acoustic wave generating device shown in FIG. 4.

A voice generator of the electrostatic acoustic wave generating device 10 shown in FIG. 4 can be manufactured according to a method shown in FIG. 5, for example. Specifically, as shown in FIG. 5 (*a*), photolithography and dry etching are first performed on a silicon on insulator (SOI) substrate composed of a base silicon layer 41 of a thickness of 400 μm, an insulating layer 42 made of oxide silicon having a thickness of 5 μm formed on the upper surface of the base silicon layer 41, and a silicon active layer 43 of a thickness of 20 μm formed on the upper surface of the insulating layer 42 to remove the silicon active layer 43 partially by etching into slits reaching the insulating layer 42, thereby forming the circular vibrating body 12 of a diameter of 1000 μm and the first frame 21 surrounding the vibrating body 12. At this time, a plurality of beam portions connecting the vibrating body 12 and the first frame 21 to each other is left without being removed by etching to form the plate springs 24 (of a width of 100 μm and a length of 100 μm, for example). Then, a two-layer Ti/Au film (0.3 μm of Ti/1 μm of Au) to become the terminal 25 of the first frame 21 is formed by sputtering process on a surface of the silicon active layer 43. The base silicon layer 41 and the silicon active layer 43 are used as electrodes for generating electrostatic attraction, so that these layers are made of conductive silicon of low resistance (0.02 Ωcm, for example).

Next, as shown in FIG. 5 (*b*), a photosensitive epoxy resin (SU-8) layer of a thickness of 100 μm is formed by spin coating process on the surface of the silicon active layer 43. Then, photolithography is performed to leave the SU-8 in circular columnar shapes (a diameter of 100 μm) on the first frame 21 and on the center of the vibrating body 12, thereby forming the fixing member 23 and the end 14*b* of the connection member 14. As shown in FIG. 5 (*c*), a silicon substrate 44 of low resistance (resistivity of 0.02 Ωcm) dedicated to the fixed electrode 11 and having a thickness of 200 μm is bonded to end surfaces of the SU-8 (the fixing member 23 and the end 14*b* of the connection member 14) formed in FIG. 5 (*b*), and a two-layer Ti/Au film (0.3 μm of Ti/1 μm of Au) to become the terminal 11*b* of the fixed electrode 11 is formed on a surface of the silicon substrate 44. As shown in FIG. 5 (*d*), photolithography and dry etching are performed to form a circular slit of an inner diameter of 120 μm and a width of 20 μm at a position corresponding to the SU-8 (the end 14*b* of the connection member 14) on the center of the vibrating body 12, and the center 14*a* of the connection member 14 is formed inside the circular slit.

As shown in FIG. 5 (*e*), photolithography and dry etching are performed on a silicon substrate 45 of low resistance (resistivity of 0.02 Ωcm) having a thickness of 400 μm to remove the silicon substrate 45 by etching into slits reaching a depth of 20 μm, thereby forming the circular vibrating electrode 13 of a diameter of 1000 μm and the second frame 22 surrounding the vibrating electrode 13. At this time, a plurality of beam portions connecting the vibrating electrode 13 and the second frame 22 to each other is left without being removed by etching to form the plate springs 26 (of a width of 100 μm and a length of 100 μm, for example). Then, a two-layer Ti/Au film (0.3 μm of Ti/1 μm of Au) to become the terminal 27 of the second frame 22 is formed by sputtering process on a surface of the silicon substrate 45 on the opposite side of the vibrating electrode 13.

As shown in FIG. 5 (*f*), a photosensitive epoxy resin (SU-8) layer of a thickness of 100 μm is formed by spin coating process on a surface closer to the vibrating electrode 13 in FIG. 5 (*e*). Then, photolithography is performed to leave the SU-8 in circular columnar shapes (a diameter of 100 μm) on the second frame 22 and on the center of the vibrating electrode 13, thereby forming the fixing member 23 and the end 14*b* of the connection member 14. Next, the fixed electrode 11 and the center 14*a* of the connection member 14 formed in FIG. 5 (*d*) are bonded to end surfaces of the SU-8 (the fixing member 23 and the end 14*b* of the connection member 14). This bonding is realized in such a manner that the SU-8 on the center of the vibrating electrode 13 (the end 14*b* of the connection member 14) is arranged inside the circular slit at the center of the fixed electrode 11 (the center 14*a* of the connection member 14), thereby forming the connection member 14 including the center 14*a* and the both ends 14*b*.

As shown in FIG. 5 (*g*), photolithography and dry etching are performed on the surface of the silicon substrate 45 on the opposite side of the vibrating electrode 13, thereby removing the silicon substrate 45 by etching to reach a depth resulting from the etching in FIG. 5 (*e*) within a range covering the vibrating electrode 13 and the plate spring 26 while leaving the silicon substrate 45 on a part of the second frame 22, on the vibrating electrode 13, and on the plate spring 26. Finally, as shown in FIG. 5 (*h*), photolithography and dry etching are performed, thereby removing the base silicon layer 41 by etching to reach the insulating layer 42 within a range covering the vibrating body 12 and the plate spring 24 and removing the insulating layer 42 on the vibrating body 12 and on the plate spring 24 while leaving the base silicon layer 41 on a part of the first frame 21. In this way, the voice generator of the electrostatic acoustic wave generating device 10 shown in FIG. 4 can be manufactured.

In the electrostatic acoustic wave generating device 10, the vibrating body 12 and the vibrating electrode 13 are arranged in such a manner that the fixed electrode 11 is held therebetween, and a hole is not required to be formed at the external vibrating body 12 and vibrating electrode 13. This makes it unlikely that dust, water, moisture, etc. will come in between the fixed electrode 11 and the vibrating body 12 or between the fixed electrode 11 and the vibrating electrode 13, in comparison to the conventional electrostatic speaker in which a hole is formed at each external fixed electrode. Thus, it becomes possible to suppress adhesion of dust, etc. to the vibrating body 12, the vibrating electrode 13, and the fixed electrode 11 and to prevent the occurrence of discharge, thereby allowing extension of the lifetime of the vibrating body 12. For example, the lifetime of the vibrating body 12 can be extended to three to five times the lifetime of the diaphragm of the conventional electrostatic speaker.

In the electrostatic acoustic wave generating device 10, the through hole 11*a* formed at the fixed electrode 11 is used only for the passage of the connection member 14. This makes it possible to reduce the ratio of the hole 11*a* relative to the surface area of the fixed electrode 11 considerably in comparison to a hole used for passage of an acoustic wave. For this reason, even in the presence of the through hole 11*a*, substantially no reduction occurs in the sound pressure of an acoustic wave generated by the vibrating body 12. This achieves reduction in power consumption in comparison to the conventional electrostatic speaker largely affected by the hole at each fixed electrode.

In the electrostatic acoustic wave generating device 10, as the vibrating body 12 is arranged external to the fixed electrode 11, an acoustic wave output from the vibrating body 12 can be transmitted to the outside without disturbance in the waveform of the acoustic wave caused by interference, thereby allowing increased sound quality. The electrostatic acoustic wave generating device 10 is used effectively, particularly when it is used as a compact electrostatic speaker. For example, the electrostatic acoustic wave generating device 10 can be used as an intelligent speaker, as a speaker of a personal computer, as a speaker of a mobile terminal, and as a speaker of a hearing aid. In the example shown in FIGS. 4 and 5, a driving voltage is from about 200 to about 600 V.

In the electrostatic acoustic wave generating device 10 shown in FIGS. 4 and 5, as the vibrating body 12 and the vibrating electrode 13 have the same configuration, the vibrating body 12 and the vibrating electrode 13 may be exchanged. In the electrostatic acoustic wave generating device 10, as the vibrating body 12 and the vibrating electrode 13 are connected to each other through the connection member 14, only one of the vibrating body 12 and the vibrating electrode 13 may be supported by the support 15.

Figure 1:
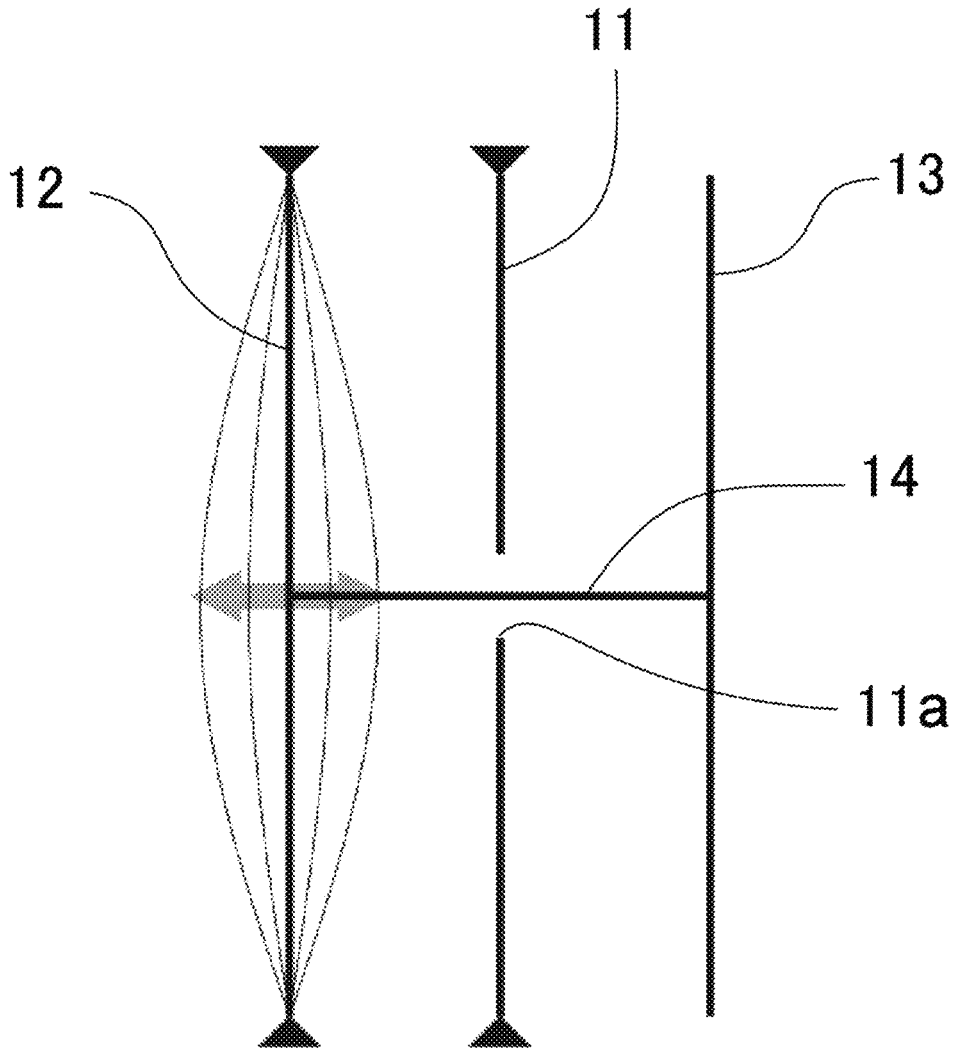
FIG. 1 is an explanatory view showing principles of outputting an acoustic wave in an electrostatic acoustic wave generating device according to the present invention.
Figure 6:
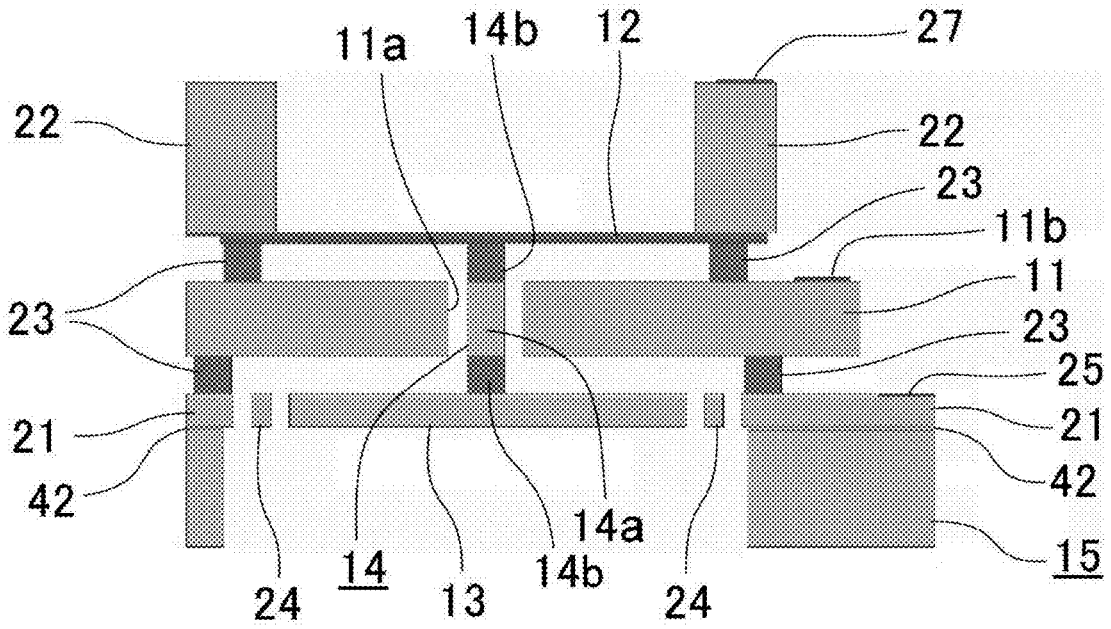
FIG. 6 is a sectional view showing a modification of the electrostatic acoustic wave generating device according to the embodiment of the present invention in which a vibrating body is made of a thin film.

As shown in FIG. 6, in the electrostatic acoustic wave generating device 10, the vibrating body 12 and/or the vibrating electrode 13 may be made of a thin film. Even in this case, an acoustic wave can still be output by causing the vibrating body 12 to vibrate on the basis of the principles show in FIGS. 1 and 2. In the example shown in FIG. 6, the vibrating body 12 is made of a thin film and the vibrating electrode 13 has a plate-like shape. Preferably, the thin film has a thickness from 1 to 50 μm and a diameter of equal to or less than 5 mm.

Figure 7:
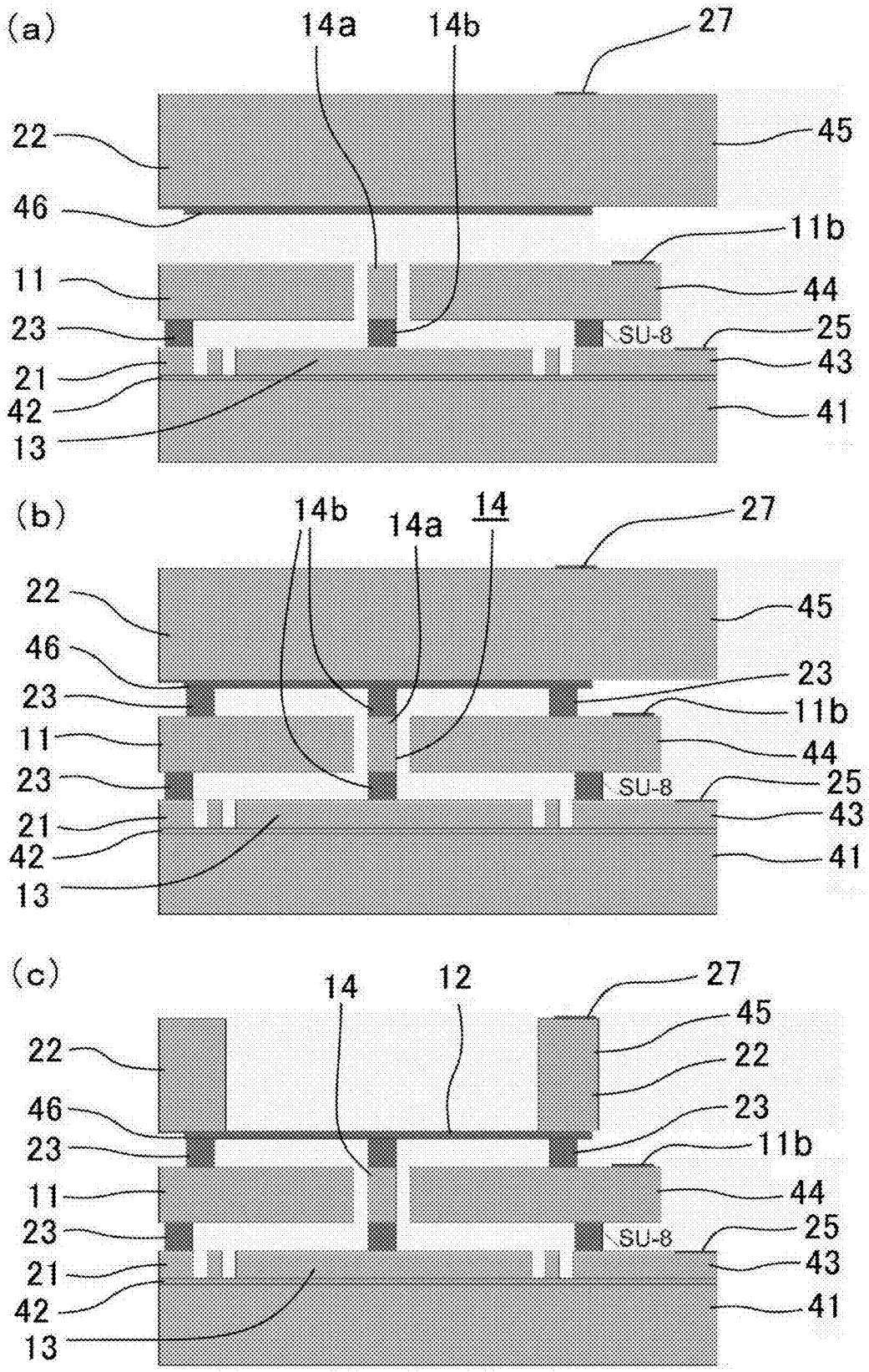
FIG. 7 is a sectional view showing a method of manufacturing a voice generator of the electrostatic acoustic wave generating device shown in FIG. 6.
Figure 8:
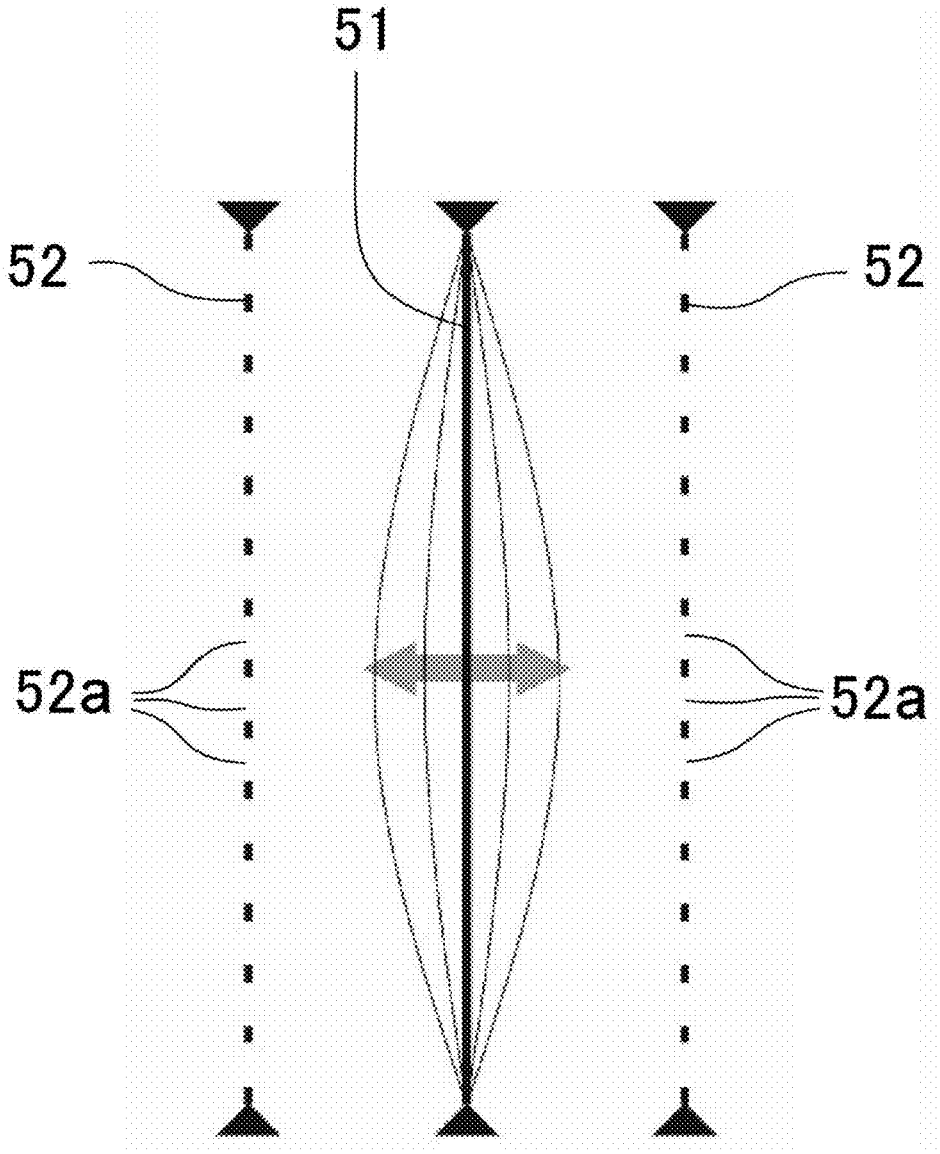
FIG. 8 is an explanatory view showing principles of outputting an acoustic wave in a conventional electrostatic speaker.
Figure 9:
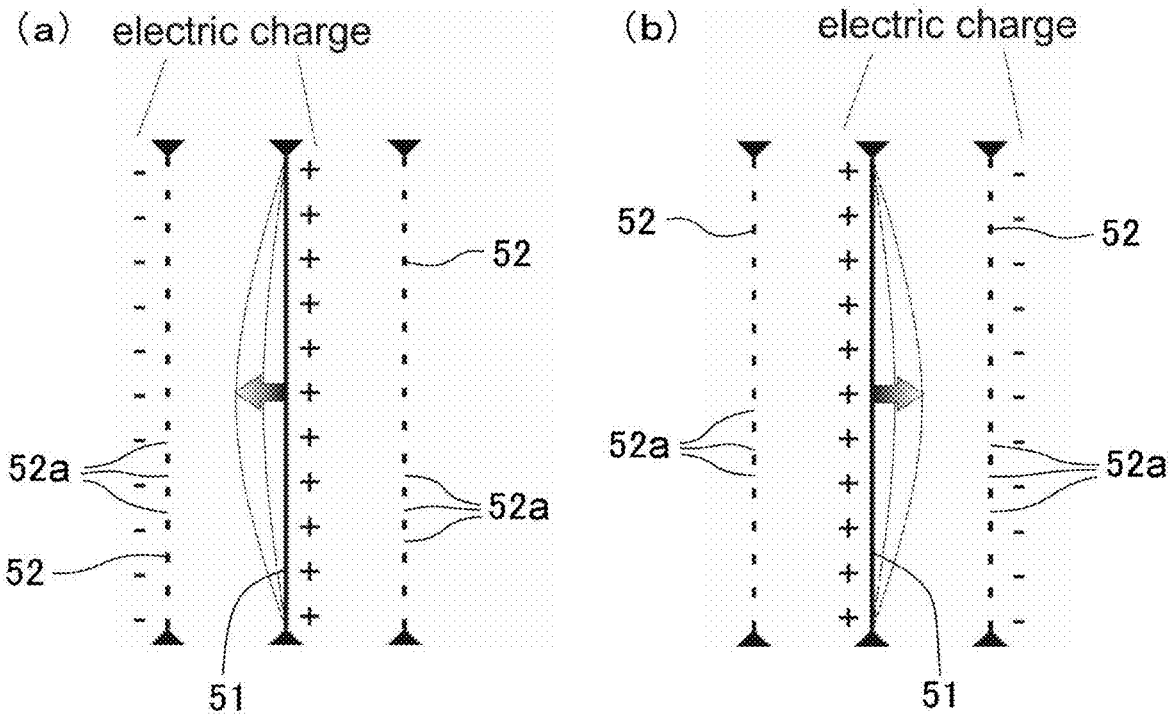
FIG. 9 is an explanatory view showing the principles of outputting an acoustic wave in the conventional electrostatic speaker applied when (a) electrostatic attraction is caused to act between a diaphragm and one of fixed electrodes, and (b) electrostatic attraction is caused to act between the diaphragm and the other fixed electrode.

A voice generator in FIG. 6 can be manufactured by a method shown in FIGS. 5 (*a*) to (*d*) and FIG. 7, for example. Specifically, the steps of FIGS. 5 (*a*) to (*d*) are performed while the vibrating body 12 and the vibrating electrode 13 are arranged conversely. Then, as shown in FIG. 7 (*a*), a circular thin film layer 46 made of parylene (vibrating body 12) is formed on a surface of the silicon substrate 45 of low resistance (resistivity of 0.02 Ωcm) having a thickness of 400 μm. Furthermore, a two-layer Ti/Au film (0.3 μm of Ti/1 μm of Au) to become the terminal 27 of the second frame 22 is formed by sputtering process on a surface of the silicon substrate 45 on the opposite side of the thin film layer 46.

As shown in FIG. 7 (*b*), a photosensitive epoxy resin (SU-8) layer of a thickness of 100 μm is formed by spin coating process on a surface of the thin film layer 46. Then, photolithography is performed to leave the SU-8 in circular columnar shapes (a diameter of 100 μm) on a peripheral portion and on the center of the thin film layer 46, thereby forming the fixing member 23 and the end 14*b* of the connection member 14. Then, the fixed electrode 11 and the center 14*a* of the connection member 14 formed in FIG. 5 (*d*) are bonded to end surfaces of the SU-8 (the fixing member 23 and the end 14*b* of the connection member 14). This bonding is realized in such a manner that the SU-8 on the center of the thin film layer 46 (the end 14*b* of the connection member 14) is arranged inside the circular slit at the center of the fixed electrode 11 (the center 14*a* of the connection member 14), thereby forming the connection member 14 including the center 14*a* and the both ends 14*b*.

As shown in FIG. 7 (*c*), photolithograph and dry etching are performed to remove the silicon substrate 45 by etching while leaving the silicon substrate 45 on a peripheral portion of the thin film layer 46. Finally, photolithography and dry etching are performed, thereby removing the base silicon layer 41 by etching to reach the insulating layer 42 within a range covering the vibrating electrode 13 and the plate spring 24 and removing the insulating layer 42 on the vibrating electrode 13 and on the plate spring 24 while leaving the base silicon layer 41 on a part of the first frame 21. In this way, the voice generator of the electrostatic acoustic wave generating device 10 shown in FIG. 6 can be manufactured.

REFERENCE SIGNS LIST

10: Electrostatic acoustic wave generating device
11: Fixed electrode

11*a*: Through hole
11*b*: Terminal
12: Vibrating body
13: Vibrating electrode
14: Connection member
15: Support
21: First frame
22: Second frame
23: Fixing member
24, 26: Plate spring
25, 27: Terminal
16: Voice signal input means
31: Bias generator
32: Voltage converter
32*a*: Voice input terminal
41: Base silicon layer
42: Insulating layer
43: Silicon active layer
44: Silicon substrate
45: Silicon substrate
46: Thin film layer
51: Diaphragm
52: Fixed electrode

What is claimed is:

1. An electrostatic acoustic wave generating device comprising:

a fixed electrode of a plate-like shape having one through hole penetrating the thickness of the fixed electrode, the fixed electrode being a single fixed electrode provided in the electrostatic acoustic wave generating device;

a vibrating body of a plate-like or film-like shape arranged closer to one surface of the fixed electrode in such a manner as to face the fixed electrode, and movable at least at the center in the thickness direction thereof relative to the fixed electrode;

a vibrating electrode of a plate-like or film-like shape arranged closer to the other surface of the fixed electrode in such a manner as to face the fixed electrode, and movable at least at the center in the thickness direction thereof relative to the fixed electrode; and a connection member connecting the vibrating body and the vibrating electrode to each other through the through hole of the fixed electrode in such a manner as to cause the vibrating body and the vibrating electrode to move toward the same direction.

2. The electrostatic acoustic wave generating device according to claim 1, wherein the through hole is provided in the center of the fixed electrode through the thickness; and the connection member is connecting the center of the vibrating body and the center of the vibrating electrode to each other through the through hole of the fixed electrode.

3. The electrostatic acoustic wave generating device according to claim 1, wherein the electrostatic acoustic wave generating device is configured to move the vibrating body using electrostatic attraction between the fixed electrode and the vibrating body and move the vibrating electrode using electrostatic attraction between the fixed electrode and the vibrating electrode.

4. The electrostatic acoustic wave generating device according to claim 1, comprising voice signal input means configured to be capable of applying a voltage to the fixed electrode, the vibrating body, and the vibrating electrode.

5. The electrostatic acoustic wave generating device according to claim 4, wherein the voice signal input means is configured to apply a positive or negative bias voltage to the fixed electrode, convert a voice signal to an analog signal on the basis of the bias voltage, generate an inversion signal by inverting the polarity of the analog signal, and apply the analog signal and the inversion signal to the vibrating body and the vibrating electrode respectively or to the vibrating electrode and the vibrating body respectively.

6. An electrostatic speaker comprising the electrostatic acoustic wave generating device according to claim 1.

* * * * *